US007979923B2

(12) United States Patent
Hsu

(10) Patent No.: US 7,979,923 B2
(45) Date of Patent: Jul. 19, 2011

(54) URINAL DEODORIZER SET

(76) Inventor: Johnson J. Y. Hsu, Taichung County (TW)

( * ) Notice: Subject to any disclaimer, the term of this patent is extended or adjusted under 35 U.S.C. 154(b) by 459 days.

(21) Appl. No.: 12/292,586

(22) Filed: Nov. 21, 2008

(65) Prior Publication Data

US 2009/0151059 A1 Jun. 18, 2009

(51) Int. Cl.
*E03D 13/00* (2006.01)
*E03D 9/02* (2006.01)

(52) U.S. Cl. ..... 4/309; 4/222.1; 4/231

(58) Field of Classification Search ..... 4/309, 222, 4/222.1, 227.5–227.7, 231
See application file for complete search history.

(56) References Cited

U.S. PATENT DOCUMENTS

| | | | | |
|---|---|---|---|---|
| 4,777,670 | A * | 10/1988 | Klinkhammer et al. | 4/231 |
| 7,832,025 | B2 * | 11/2010 | Virica et al. | 4/227.4 |
| 7,908,680 | B2 * | 3/2011 | Akitsu | 4/223 |
| 2007/0245470 | A1 * | 10/2007 | Nguyen et al. | 4/223 |

FOREIGN PATENT DOCUMENTS

DE 3817373 A1 * 11/1989

* cited by examiner

*Primary Examiner* — Jamisue A Plucinski
*Assistant Examiner* — Brian D Mattei
(74) *Attorney, Agent, or Firm* — Bacon & Thomas, PLLC

(57) ABSTRACT

A urinal deodorizer set includes a support frame member, which has an upright board, a sloping flow guide board disposed at the top side of the upright board, and first diversion boards perpendicularly extended from the upright board and the sloping flow guide board, a holder frame member, which has an outer upright board, an arched bottom board, two sideboards, and second diversion boards perpendicularly extended from the outer upright boards and respectively abutted against the first diversion boards and defining with the first diversion boards an accommodation space, a deodorizer block accommodated in the accommodation space, and an anchoring member provided at the support frame member for securing the urinal deodorizer set to the vertical wall of a urinal to let flushing water run through the urinal deodorizer in mixing with the deodorizer block to achieve effective cleaning of the vertical and bottom walls of the urinal.

9 Claims, 6 Drawing Sheets

URINAL DEODORIZER SET

BACKGROUND OF THE INVENTION

1. Field of the Invention

The present invention relates to deodorizing agent dispensing technology and more particularly to a urinal deodorizer set for use in a urinal for cleaning and bad odor elimination.

2. Description of the Related Art

Many urinal deodorizer blocks are known for use in a urinal to eliminate bad odor. A regular urinal deodorizer block generally comprises a housing and solid deodorizing agent accommodated in the housing. When in use, the urinal deodorizer block is put in the bottom side inside the urinal. However, when a user is discharging urine into the urinal, the urinal deodorizer block may cause discharged urine to fly about and to wet the user's paints. Further, when cleaning the urinal with flushing water, flushing water will be temporarily accumulated in the bottom side inside the urinal before running out of the bottom drain port of the urinal, and temporarily accumulated water will enter the housing of the urinal deodorizer block to dissolve a part of the solid deodorizing agent. However, because the structure of the filter that is mounted in the bottom drain port of the urinal does not fit the housing of the urinal deodorizer block, the solid deodorizing agent of the urinal deodorizer block cannot be properly dissolved to effectively clean the inside bottom wall of the urinal and the drain pipe and eliminate bad odor.

Furthermore, conventional urinal deodorizer blocks have a fatal drawback. When a male person is urinating, most discharged urine falls to the lower part of the inside vertical wall of the urinal. However, a urinal deodorizer block is to be placed on the bottom side inside a urinal. Therefore, a conventional urinal deodorizer block cannot clean the vertical wall inside the urinal. An improvement in this regard is necessary. Further, people may hang a deodorizer or mothballs in a urinal to eliminate bad odor. However, if the hanging position is in the flush path, flushing water will splash against the deodorizer or mothballs, and splashed water may fall to the body of the user, causing trouble.

SUMMARY OF THE INVENTION

The present invention has been accomplished under the circumstances in view. It is the main object of the present invention to provide a urinal deodorizer set, which guides flushing water to mix with a solid deodorizing agent, thereby cleaning the vertical inside wall and bottom wall of the urinal and the inner surface of the drain pipe and effectively eliminating bad odor.

It is another object of the present invention to provide a urinal deodorizer set, which is mountable on the vertical inside wall of a urinal in the flush path without causing water to splash.

To achieve these and other objects of the present invention, a urinal deodorizer set comprises a support frame member, a holder frame member, an anchoring member, and a deodorizer. The support frame member comprises an upright board, a flow guide board obliquely outwardly extended from the op side of the upright board, and a plurality of first diversion boards perpendicularly extended from the upright board and the flow guide board and equally spaced from one another at a predetermined distance. The holder frame member is fastened to the support frame member to define with the support frame member an accommodation space. The holder frame member comprises an outer upright board, an arched bottom board extending from a bottom side of the outer upright board to a place below the upright board of the support frame member and defining with the support frame member a water outlet, two sideboards connected to the outer upright board and the arched bottom board at two opposite lateral sides to surround the support frame member, and a plurality of second diversion boards perpendicularly extended from the outer upright board in alignment with the first diversion boards of the support frame member. The second diversion boards is notched so that the accommodation space is defined in between the first diversion boards and the second diversion boards. The anchoring member is provided at the support frame member for fastening to the vertical inside wall of a urinal in the flush path.

DETAILED DESCRIPTION OF THE INVENTION

Figure 1:
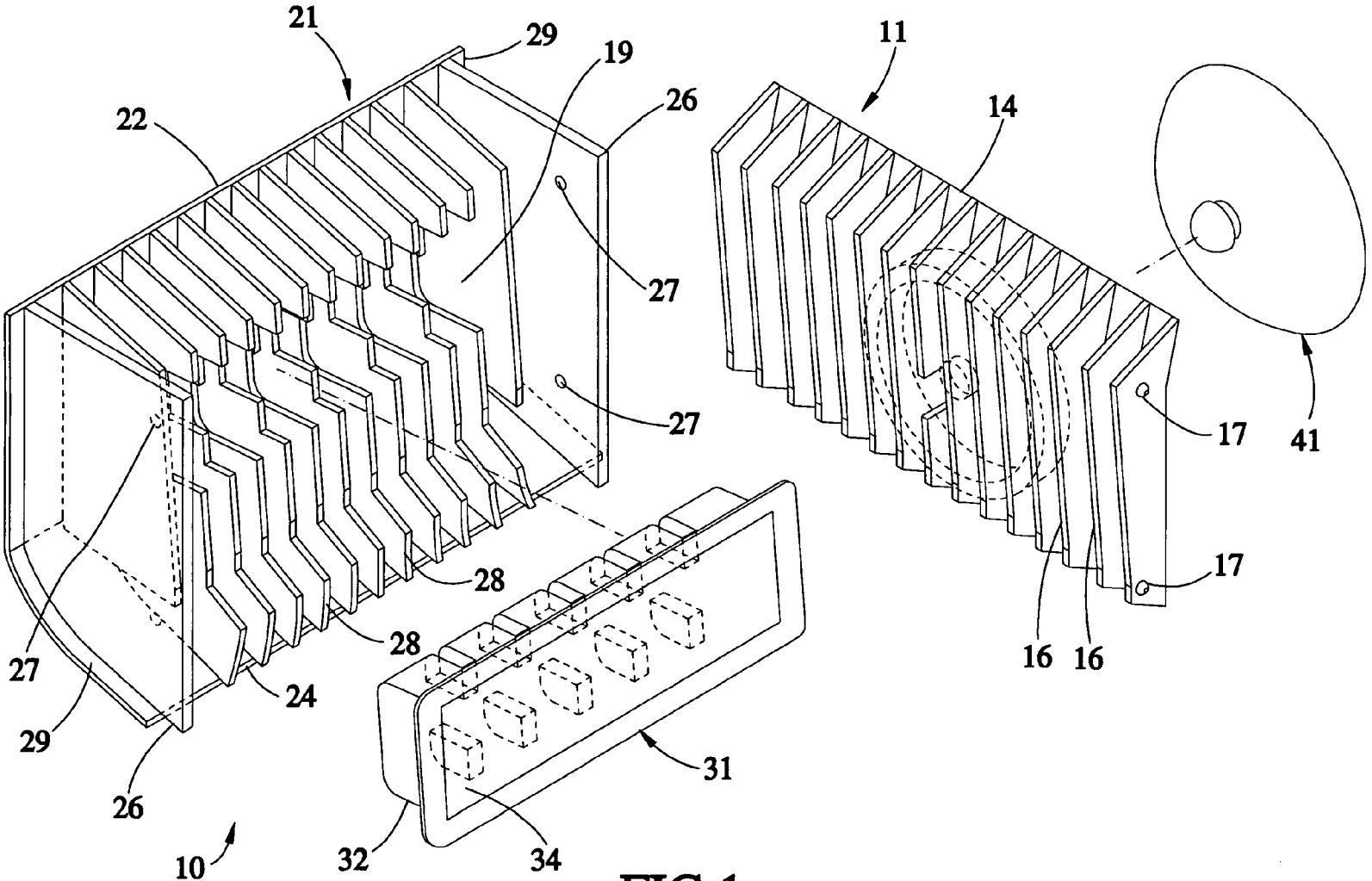
FIG. 1 is an exploded view of a urinal deodorizer set according to the present invention.
Figure 2:
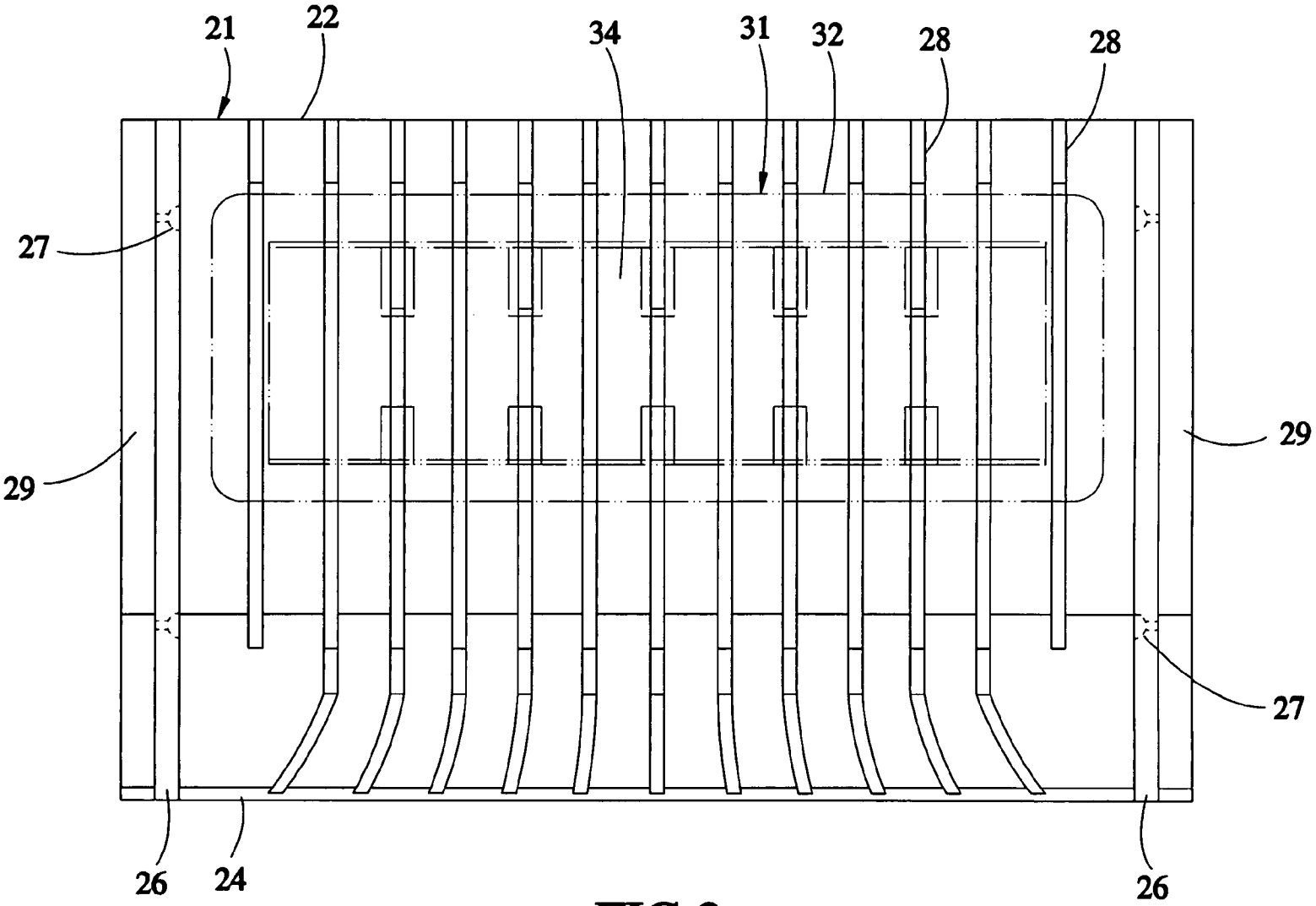
FIG. 2 is a front view of a part of the present invention, showing the positioning of the deodorizer block in the holder frame member of the urinal deodorizer set.
Figure 3:
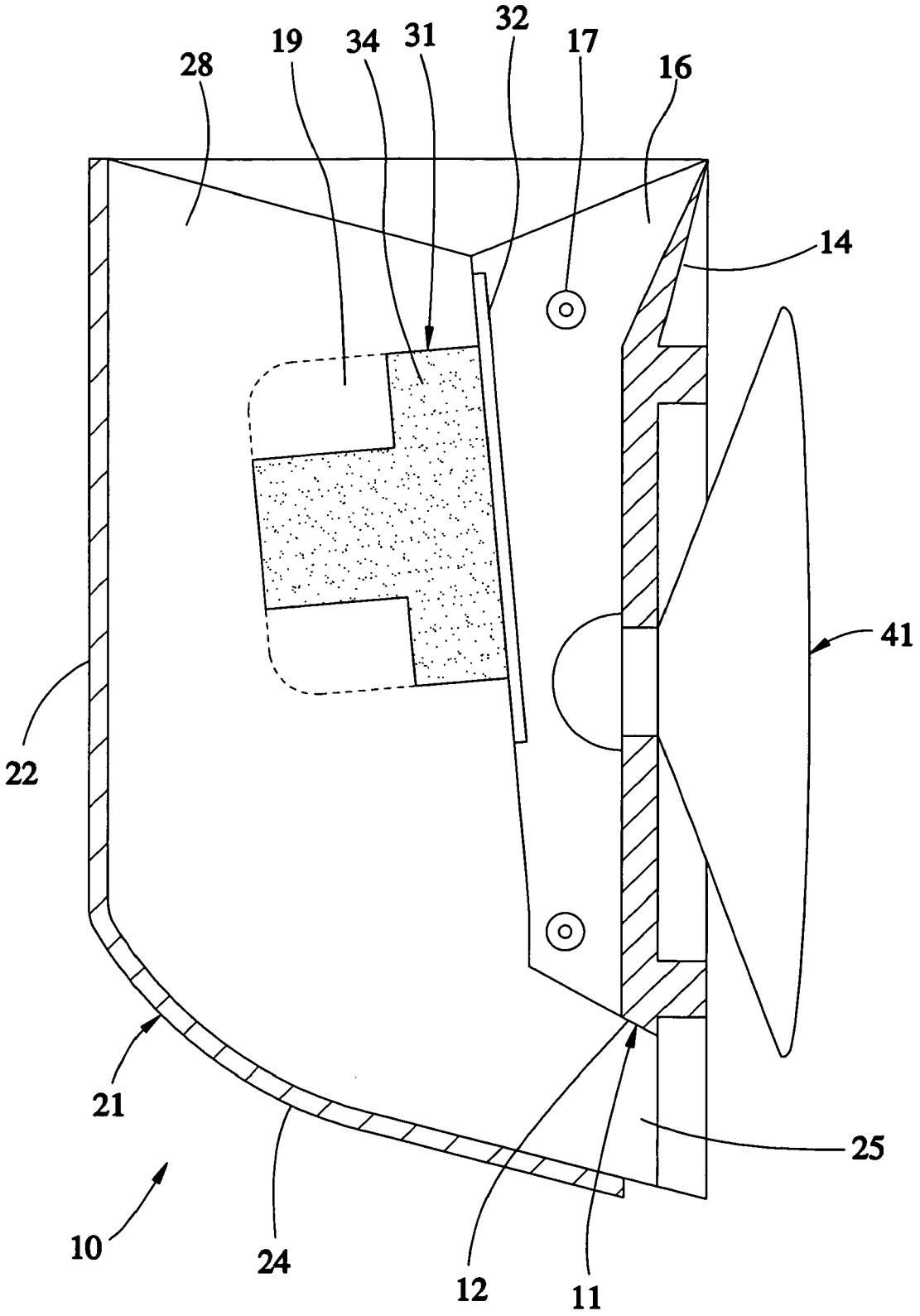
FIG. 3 is a sectional side view of the present invention, showing the status of the urinal deodorizer after removal of the sideboards.
Figure 4:
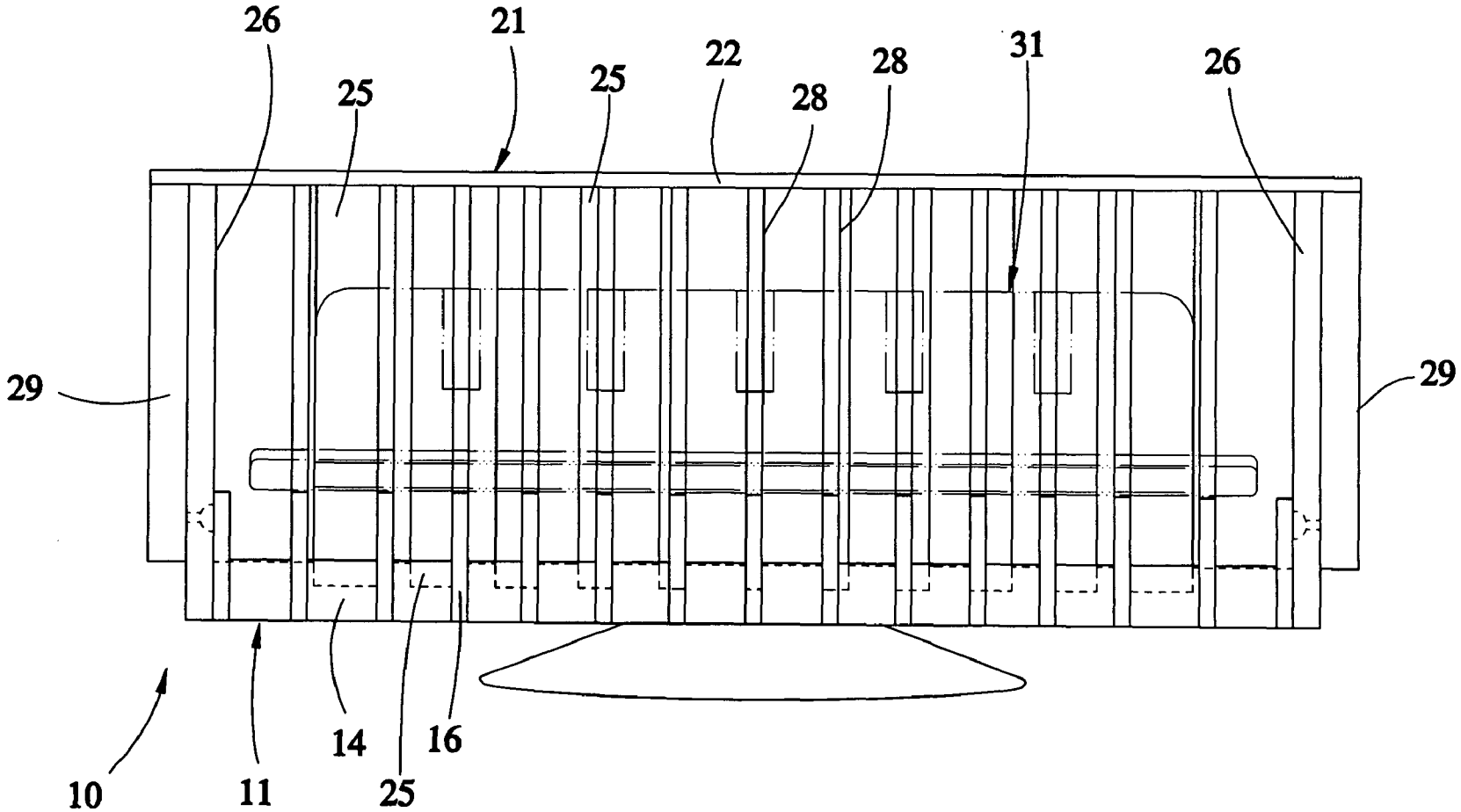
FIG. 4 is a sectional top view of the present invention, showing the connection status of the support frame member and the holder frame member.

Referring to FIGS. 1~4, a urinal deodorizer set 10 in accordance with the preferred embodiment of the present invention is shown comprised of a support frame member 11, a holder frame member 21, a deodorizer block 31, and an anchoring member 41.

The support frame member 11 comprises an upright board 12, a flow guide board 14 obliquely outwardly extended from the top side of the upright board 12, and a plurality of first diversion boards 16 perpendicularly extended from the upright board 12 and the flow guide board 14 and equally spaced from one another at a predetermined distance, and a plurality of raised portions 17 respectively protruded from the outer surface of each of the two diversion boards 16 at two opposite lateral sides of the support frame member 11.

The holder frame member 21 comprises an outer upright board 22, an arched bottom board 24 extending from the bottom side of the outer upright board 22, which extends to a place below the upright board 12 of the support frame member 11 and defines with the support frame member 11 a water outlet 25 after connection between the support frame member 11 and the holder frame member 21, two sideboards 26 connected to the outer upright board 22 and the arched bottom board 24 at two opposite lateral sides to surround the support frame member 11, and a plurality of second diversion boards 28 perpendicularly extended from the outer upright board 22 and respectively aimed at the first diversion boards 16 of the support frame member 11. The second diversion boards 28 are notched so that an accommodation space 19 is defined in between the first diversion boards 16 of the support frame member 11 and the second diversion boards 28 of the holder frame member 21. Further, the outer upright board 22 and the arched bottom board 24 protrude over the two sideboards 26 at a predetermined distance, thereby forming two side wings 29 at two opposite lateral sides. Further each sideboard 26 has a plurality of recessed portions 27 respectively forced into engagement with the raised portions 17 when the support frame member 11 and the holder frame member 21 are assembled together.

The first diversion boards 16 of the support frame member 11 and the second diversion boards 28 of the holder frame member 21 have the respective topmost edge sloping downwardly inwards toward the inside of the urinal deodorizer set 10. Each first diversion board 16 has its front edge sloping downwardly backwards toward the upright board 12. The second diversion boards 28 have the respective front edges respectively abutted against the front edges of the first diversion boards 16. Further, the second diversion boards 28 have the respective bottom sides respectively curved outwards in direction from the middle of the holder frame member 21 toward the two opposite sideboards 26 so that the width of the gap between each two adjacent second diversion boards 28 is gradually increased in direction from the outer upright wall 21 toward the support frame member 11.

The deodorizer block 31 comprises a housing 32 accommodated in the accommodation space 19, and a solid deodorizing agent 34 accommodated in the housing 32. Further, the solid deodorizing agent 3 contains a surfactant.

The anchoring member 41 according to the present preferred embodiment is a vacuum mount provided at the support frame member 11.

Figure 5:
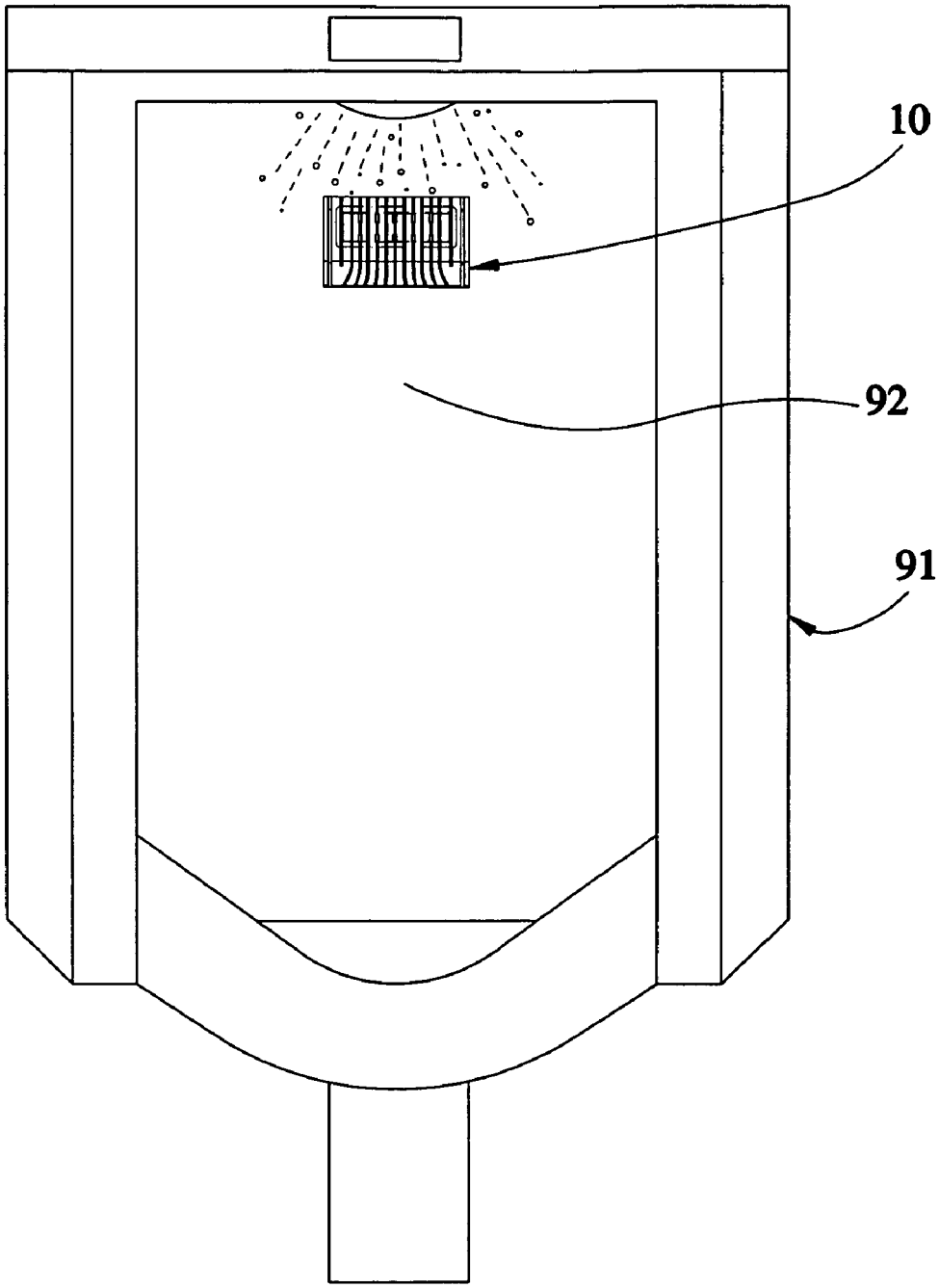
FIG. 5 is a schematic drawing of the present invention, showing a status of use of the urinal deodorizer set in a urinal.

Before use of the urinal deodorizer set 10, as shown FIG. 5, the anchoring member 41 of the urinal deodorizer set 10 is fastened to an upper part of the vertical inside wall 92 inside the urinal 91 for enabling flushing water to run through the urinal deodorizer set 10. After installation, the topmost edge of the flow guide board 14 is kept closely attached to the surface of the vertical inside wall 92 of the urinal 91.

Referring to FIGS. 3 and 5 again, when water is discharged to flush the urinal 91, the flow guide board 14 guides the flushing water from the vertical inside wall 92 toward the inside of the urinal deodorizer set 10. When flushing water is running through the urinal deodorizer set 10, the first diversion boards 16 and the second diversion boards 28 guide the flushing water to run over the surface and back side of the deodorizer block 31. Because of a high flow rate of the flushing water, the gap between the upright board 12 and the urinal deodorizer set 10 is insufficient to admit the flushing water. Therefore, the flushing water is temporarily accumulated in the urinal deodorizer set 10 to mix with the deodorizer block 31, dissolving a part of the solid deodorizing agent 34 of the deodorizer block 31 while a part of the flushing water runs through the gaps between the outer upright board 22 and the deodorizer block 31 toward the lower part of the vertical inside wall 92 of the urinal 91 via the water outlet 25. Thus, the water that flows out of the water outlet 25 carries the dissolved surfactant, and the dissolved surfactant is applied to the lower part of the vertical inside wall 92 of the urinal 91, the top surface of the bottom wall of the urinal 91 and the inside surface of the drain pipe (not shown) of the urinal 91. The layer of the dissolved surfactant forms a protective layer on the surface of the vertical inside wall 92 and bottom wall of the urinal 91 and the inside surface of the drain pipe to prohibit adherence of urine during a next use of the urinal 91, and therefore a urinal deodorizing action is performed.

The invention has other effects as described hereinafter. The arrangement of the first diversion boards 16 and second diversion boards 28 and the design of the inwardly sloping top edges of the diversion boards 16 and 28 facilitate flowing of flushing water into the spaces in between the diversion boards 16 and 28 to mix with the deodorizer block 31. Further, the design in which the gap at the bottom side between each two adjacent second diversion boards 28 is relatively greater from the middle toward the two opposite lateral sides facilitates spreading of flushing water so that flushing water is spread out widely when flowed out of the water outlet 25. Further, the second diversion boards 28 have the respective front edges respectively abutted against the front edges of the first diversion boards 16 in a sloping manner so that the deodorizer block 31 is kept in the accommodation space 19 obliquely to facilitate contact of the deodorizer block 31 with flushing water. Further, flushing water that flows over the outside of the two sideboards 26 is guided by the side wings 29 toward the vertical inside wall 92 of the urinal 91.

Figure 6:
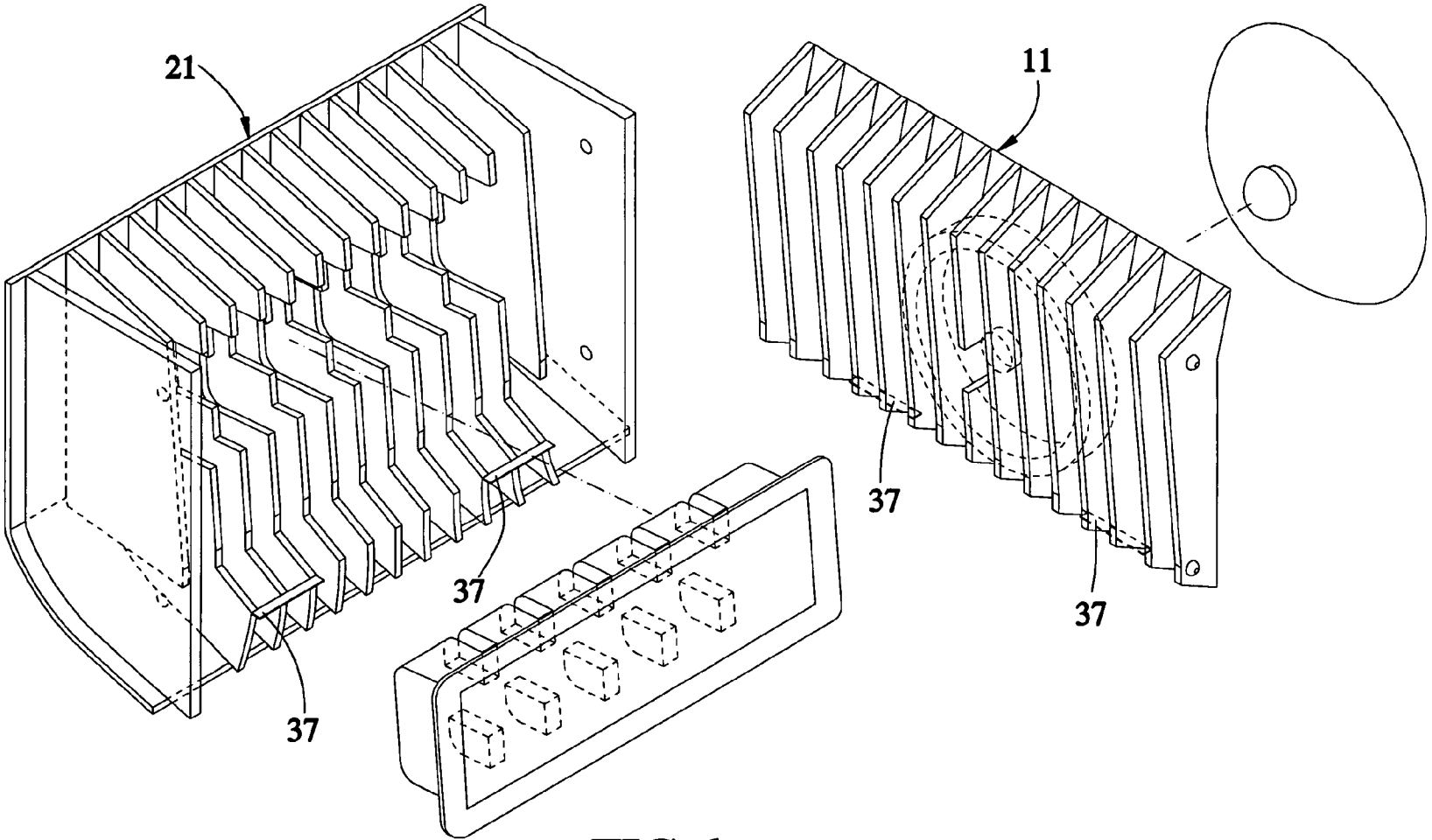
FIG. 6 is an exploded view of an alternate form of the present invention, showing connection elements provided at the support frame member and the holder frame member.

Further, connection elements 37 are respectively provided at the support frame member 11 and the holder frame member 21 near the bottom side, as shown in FIG. 6, so that the e support frame member 11 and the holder frame member 21 can be connected together by, for example, hinge means.

In conclusion, the invention provides a urinal deodorizer set that achieves the following advantages:

1. Urinal cleaning and deodorizing effects: The urinal deodorizer set guides flushing water into mix with a deodorizer block, achieving cleaning of the vertical wall and bottom wall of the urinal and removing bad smells. When compared to conventional designs, the invention provides better deodorizing effect.

2. Splash prevention: The urinal deodorizer set can be mounted on the vertical wall in the flush path, avoiding splash of water.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A urinal deodorizer set, comprising:

a support frame member, said support frame member comprising an upright board, a flow guide board obliquely outwardly extended from a top side of said upright board, and a plurality of first diversion boards perpendicularly extended from said upright board and said flow guide board and equally spaced from one another at a predetermined distance;

a holder frame member fastened to said support frame member and defining with said support frame member an accommodation space therebetween, said holder frame member comprising an outer upright board, an arched bottom board extending from a bottom side of said outer upright board to a place below said upright board of said support frame member and defining with said support frame member a water outlet, two sideboards connected to said outer upright board and said arched bottom board at two opposite lateral sides to surround said support frame member, and a plurality of second diversion boards perpendicularly extended from said outer upright board in alignment with said first diversion boards of said support frame member, said second diversion boards being notched so that said accommodation space is defined in between said first diversion boards and said second diversion boards; and an anchoring member provided at said support frame member.

2. The urinal deodorizer set as claimed in claim 1, further comprising a deodorizer block accommodated in said accommodation space.

3. The urinal deodorizer set as claimed in claim 1, wherein said first diversion boards and said second diversion boards each have the respective topmost edge respectively sloping downwards from said upright board of said support frame member and said outer upright board of said holder frame member toward the inside of said urinal deodorizer set.

4. The urinal deodorizer set as claimed in claim 1, wherein said second diversion boards have respective bottom sides respectively curved outwards in direction from a middle part of said holder frame member toward said two opposite sideboards so that the width of the gap between each two adjacent second diversion boards is gradually increased in direction from said outer upright wall of said holder frame member toward said support frame member.

5. The urinal deodorizer set as claimed in claim 1, wherein said anchoring member is a vacuum mount.

6. The urinal deodorizer set as claimed in claim 1, wherein said first diversion boards each have a front edge sloping downwardly backwards toward said upright board of said support frame member; said second diversion boards each have a front edge respectively abutted against said first diversion boards.

7. The urinal deodorizer set as claimed in claim 1, wherein said outer upright board and said arched bottom board of said holder frame member protrude over said two sideboards at a predetermined distance, thereby forming two side wings at two opposite lateral sides.

8. The urinal deodorizer set as claimed in claim 1, wherein said sideboards each have a plurality of recessed portions; said support frame member comprises a plurality of raised portions protruded from two said first diversion boards at two opposite lateral sides of said support frame member and respectively forced into engagement with said recessed portions of said sideboards.

9. The urinal deodorizer set as claimed in claim 2, wherein said deodorizer block comprises a housing accommodated in said accommodation space, and a solid deodorizing agent accommodated in said housing.

* * * * *